US010301804B2

(12) United States Patent
Grenier

(10) Patent No.: US 10,301,804 B2
(45) Date of Patent: May 28, 2019

(54) METHOD AND SYSTEM OF REMOVING DEBRIS FROM PIPING IN A HIGH-RISE BUILDING PLUMBING NETWORK

(71) Applicant: Daniel Grenier, Sarasota, FL (US)

(72) Inventor: Daniel Grenier, Sarasota, FL (US)

( * ) Notice: Subject to any disclaimer, the term of this patent is extended or adjusted under 35 U.S.C. 154(b) by 301 days.

(21) Appl. No.: 14/330,879

(22) Filed: Jul. 14, 2014

(65) Prior Publication Data

US 2015/0013724 A1 Jan. 15, 2015

Related U.S. Application Data

(60) Provisional application No. 61/957,814, filed on Jul. 12, 2013.

(51) Int. Cl.

| | |
|---|---|
| ***E03C 1/304*** | (2006.01) |
| ***B08B 9/035*** | (2006.01) |
| ***B08B 9/043*** | (2006.01) |
| ***E03F 9/00*** | (2006.01) |

(52) U.S. Cl.

CPC ..... *E03C 1/304* (2013.01); *B08B 9/035* (2013.01); *B08B 9/0433* (2013.01); *E03F 9/00* (2013.01)

(58) Field of Classification Search

None

See application file for complete search history.

(56) References Cited

U.S. PATENT DOCUMENTS

| | | | | |
|---|---|---|---|---|
| 1,186,280 A | | 6/1916 | Carson | |
| 1,747,514 A | | 2/1930 | Kennedy | |
| 2,065,523 A | | 12/1936 | Groeniger | |
| 2,241,560 A | * | 5/1941 | Schouler | F16L 45/00 138/89 |
| 2,475,832 A | | 7/1949 | Gilliland | |
| 2,567,165 A | * | 9/1951 | Buskirk | E03C 1/122 285/125.1 |
| 3,346,887 A | | 10/1967 | Sommer | |
| 3,853,140 A | | 12/1974 | Gorman | |
| 4,362,628 A | * | 12/1982 | Kennedy | B01D 36/04 210/167.3 |

(Continued)

FOREIGN PATENT DOCUMENTS

| | | |
|---|---|---|
| JP | 01022390 | 1/1989 |

*Primary Examiner* — Mikhail Kornakov

*Assistant Examiner* — Pradhuman Parihar

(74) *Attorney, Agent, or Firm* — The Concept Law Group, P.A.; Scott D. Smiley; Scott M. Garrett

(57) ABSTRACT

A method of removing debris from piping within a high-rise building plumbing network includes inserting a portion of a flexible optical device and flexible water conduit into an opening defined by a plumbing system, the flexible water conduit operably coupled to a water pressure device. The method also includes coupling an end of a vacuum conduit, operably coupled to a vacuum assembly, to the opening and producing an image of a plumbing channel defined by the plumbing system with the flexible optical device. Next, the method includes maneuvering the portion of the flexible optical device within the plumbing system until the image of the plumbing channel depicts a debris at least partially obstructing the plumbing channel, inducing a stream of fluid directed at the debris, and then inducing a vacuum within the plumbing system sufficient to remove the debris from the plumbing system.

18 Claims, 6 Drawing Sheets

(56) References Cited

U.S. PATENT DOCUMENTS

| | | | | |
|---|---|---|---|---|
| 4,460,019 | A * | 7/1984 | Condon | E03F 7/00 138/90 |
| 4,587,687 | A | 5/1986 | Ikonen et al. | |
| 5,003,998 | A * | 4/1991 | Collett | B08B 5/02 134/22.12 |
| 5,085,244 | A * | 2/1992 | Funk | B08B 9/0321 134/102.1 |
| 5,529,605 | A * | 6/1996 | Mussig | B08B 7/00 134/166 C |
| 5,862,561 | A * | 1/1999 | Irwin | B08B 9/045 134/113 |
| 6,098,212 | A * | 8/2000 | Rogan | E03C 1/306 15/104.33 |
| 6,111,600 | A * | 8/2000 | McLeod | B08B 9/0495 348/84 |
| 6,394,112 | B1 * | 5/2002 | Steinmetz | B08B 9/0495 134/166 C |
| 6,425,217 | B1 | 7/2002 | Furukawa et al. | |
| 7,124,769 | B2 | 10/2006 | Sansom et al. | |
| 7,160,395 | B2 | 1/2007 | Amos | |
| 7,191,489 | B1 * | 3/2007 | Heath | B08B 3/026 15/320 |
| 8,418,274 | B2 | 4/2013 | Dodson | |
| 2004/0261849 | A1 * | 12/2004 | Sprague | E03B 7/006 137/239 |
| 2009/0038659 | A1 * | 2/2009 | Ragozzino | B08B 9/032 134/166 C |
| 2009/0288267 | A1 * | 11/2009 | Van Wagenen | H02G 1/1297 15/320 |
| 2013/0000026 | A1 * | 1/2013 | Gutierrez | A47L 7/0004 4/255.04 |
| 2013/0025046 | A1 * | 1/2013 | Yu | E03C 1/284 4/679 |

* cited by examiner

100

A-A

METHOD AND SYSTEM OF REMOVING DEBRIS FROM PIPING IN A HIGH-RISE BUILDING PLUMBING NETWORK

CROSS-REFERENCE TO RELATED APPLICATION

This application claims priority to U.S. Provisional Patent Application No. 61/957,814 filed Jul. 12, 2013, the entirety of which is incorporated by reference.

FIELD OF THE INVENTION

The present invention relates generally to a method and system for removing debris from piping and, more particularly, relates to a method and system for removing debris from piping in high-rise building plumbing systems with a camera, pressure source, and vacuum.

BACKGROUND OF THE INVENTION

It is well known that plumbing systems in high-rise buildings, i.e., buildings with at least eight to ten floors, experience numerous drainage problems, such as clogged drains and piping. This is chiefly due to the type of piping used in said buildings. More specifically, many high-rise buildings utilized piping with an internal geometry designed to balance pressures inside the plumbing system. This geometry has a disadvantage, however, of being prone to clogging because of the extreme curves and impasses disposed therein. This problem is not only prevalent in high-rise buildings, however, as many other types of buildings also experience draining issues with their plumbing systems because of similar issues.

A known method for removing debris from piping includes the application of chemical drain cleaners to the piping. Chemical drain cleaners are available in solid or liquid form. Unfortunately, chemical drain cleaners are not always effective for removing debris, especially when the debris is a solid obstruction. Furthermore, many chemical drain cleaners are dangerous and may cause damage to a user's eyes, lungs, and skin.

Another known method for removing debris from piping includes uses mechanical action, via a rigid apparatus known in the art as a "snake," to move the clogged debris. Many known snakes are limited in length and size thereby rendering them ineffective for clogs disposed far downstream of the drain or inoperable to navigate around certain bends in a plumbing system. Moreover, in many instances the snake simply transports the clogged debris further downstream so as to create the same problem it was intended to solve. This is especially true for the above-described geometry used in many high-rise buildings.

Some known systems also utilize a pressure source, a vacuum, and a hose to apply varying amounts of pressure and suction to the clogged piping. The hose is normally inserted into the piping and must be equipped with an attachment to produce a tight fit between the hose and the outer drain of the pipe to create a seal. Unfortunately, due to the various sizes and shapes of piping and drains, the attachment may not be appropriately sized for the particular clogged pipe or drain, and may result in air leaking from the connection between the hose and the pipe or drain. Additionally, the amount of air pressure and suction applied to the clogged pipe or drain must be controlled through a controlling mechanism. This is obviously a time intensive task as the air pressure and suction ratio requires constant monitoring. These systems also do not permit the user to monitor the inside of the plumbing to ensure an effective removal of the debris because of the required air-tight configuration with the single opening to which the suction device is attached. Furthermore, this method often results in moving the debris to other areas within the clogged pipe or drain, instead of removing the debris, further complicating the problem.

Therefore, a need exists to overcome the problems with the prior art as discussed above.

SUMMARY OF THE INVENTION

The invention provides a method of removing debris from pipes in high-rise building plumbing systems that overcomes the hereinafore-mentioned disadvantages of the heretofore-known devices and methods of this general type and that removing debris from piping in a high-rise building plumbing system with a camera, pressure source, and vacuum.

With the foregoing and other objects in view, there is provided, in accordance with the invention, a method of removing debris from piping within a high-rise building that includes inserting a portion of a flexible optical device into an opening defined by a plumbing system. The method continues with inserting a portion of a flexible water conduit, operably coupled to a water pressure device, into the opening defined by the plumbing system. Next, the method includes coupling an end of a vacuum conduit to the opening defined by the plumbing system, the vacuum conduit operably coupled to a vacuum assembly. The method continues with producing an image of a plumbing channel defined by the plumbing system with the flexible optical device. Next, the method continues with maneuvering the portion of the flexible optical device within the plumbing system until the image of the plumbing channel depicts debris identified as at least partially obstructing the plumbing channel. The method further includes inducing a stream of fluid through the portion of the flexible water conduit, the stream of fluid directed at the debris for a period of time until it has been dislodged. Next, the method includes inducing a vacuum within the plumbing system sufficient to remove the debris from the plumbing system.

In accordance with another feature of the present invention, the method includes coupling a y-shaped fitting to the opening defined by the plumbing system in a water-tight configuration. The y-shaped fitting includes at least two free openings. One of the at least two free openings has the end of the vacuum conduit attached thereto in a fluidly sealed configuration. The second of the at least two free openings is disposed to receive the portion of the flexible optical device and the portion of the flexible water conduit.

In accordance with another feature of the present invention, the vacuum conduit includes a transparent surface proximal to the end of the vacuum conduit.

In accordance with another feature of the present invention, the method continues with producing the image of the plumbing channel in real-time.

In accordance with a further feature, the method continues with displaying the image of the plumbing channel on a hand-held camera.

In accordance with another feature, the opening defined by the plumbing system is disposed downstream of a terminal end of the plumbing system.

In accordance with another feature, the method continues with maneuvering the flexible water conduit and the portion of the flexible optical device within the plumbing system simultaneously until the image of the plumbing channel depicts the debris identified as at least partially obstructing the plumbing channel.

In accordance with yet another feature of the present invention, the stream of fluid is of a non-gaseous substance.

In accordance with yet another feature of the present invention, the stream of fluid is water.

In accordance with another feature of the present invention, the method continues with inducing the vacuum within the plumbing system sufficient to remove the debris from the opening defined by the plumbing system.

In accordance with another feature of the present invention, the method continues with inducing a selectively pulsating stream of fluid through the portion of the flexible water conduit.

In accordance with another feature of the present invention, the method includes storing the debris in a container housed by the vacuum assembly and pumping the debris, with a pumping device fluidly coupled with the container housed by the vacuum assembly, into a secondary container, the pumping device housed by the vacuum assembly.

In accordance with another feature of the present invention, the method includes uncoupling a plurality of plumbing members at a joint in the plumbing system to create the opening defined by the plumbing system and recoupling the plurality of plumbing members after the debris has been removed to create a pre-existing fluidly sealed configuration at the joint in the plumbing system. Naturally, the aforementioned steps occur before and after the remaining steps within the present method.

In accordance with another embodiment of the present invention, the method includes inserting a portion of an elongated optical device into an opening defined by an end of one of a plurality of plumbing members constituting a part of a piping network within a plumbing system. The method further includes inserting a portion of an elongated water conduit, operably coupled to a water pressure device, into the opening defined by the end of one of the plurality of plumbing members. The method continues with coupling an end of a vacuum conduit to the opening defined by the end of one of the plurality of plumbing members, the vacuum conduit operably coupled to a vacuum assembly. Next, the method includes maneuvering the portion of the elongated optical device within the plumbing system to identify a debris at least partially obstructing the plumbing channel. In addition, the method includes inducing a stream of non-gaseous fluid through the portion of the elongated water conduit, the stream of non-gaseous fluid directed at the piece of the debris for a period of time until it has been dislodged. The method further includes inducing a vacuum within the plumbing system sufficient to remove the piece of the debris from the plumbing system.

In accordance with another feature of the present invention, the method includes coupling a three-port fitting to the opening defined by the end of one of the plurality of plumbing members in a water-tight configuration. The three-port fitting includes two available openings with one of the at least two available openings having the end of the vacuum conduit attached thereto in a fluidly sealed configuration and a second of the at least two available openings disposed to receive the portion of the elongated optical device and the portion of the elongated water conduit.

In accordance with another feature of the present invention, the method includes uncoupling a plurality of plumbing members at a joint in the plumbing system to create the opening defined by the end of one of the plurality of plumbing members and recoupling the plurality of plumbing members after the debris has been removed to create a pre-existing fluidly sealed configuration at the joint in the plumbing system. Naturally, the aforementioned steps are performed before and after the remaining steps within the method, respectively.

In accordance with another feature of the present invention, the method includes identifying the debris using real-time images of the plumbing channel on a hand-held camera.

In accordance with another feature of the present invention, the method includes controlling a speed and duration of the stream of non-gaseous fluid through a controlling mechanism.

In accordance with yet another feature of the present invention, the method include housing the debris in a container removably coupled by the vacuum assembly and pumping the debris, with a pumping device fluidly coupled to the container into a secondary container, the secondary container operable to hold at least fifty five gallons of fluid.

In accordance with another embodiment, the present invention, includes a system for removing debris from piping within high-rise buildings. The system includes a portable optical device for insertion into an opening defined by a plumbing system and a portable water pressure device having a flexible water conduit. The portable water pressure device is operable for insertion into the opening and adjacent to the portable optical device. The system also includes a portable vacuum assembly having a vacuum conduit coupled thereto. The system further includes a three-port fitting having one opening sized to mate with an opening defined by a pipe within a plumbing system and two available openings. One of the at least two available openings includes an end sized to receive, in a fluidly sealed configuration, an end of the vacuum conduit and a second of the at least two available openings sized to receive a portion of the optical device and a portion of the water conduit.

Although the invention is illustrated and described herein as embodied in a method and system of removing debris from piping within a plumbing system, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the piping used in the plumbing system, i.e., the directional flow of fluid in the plumbing system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
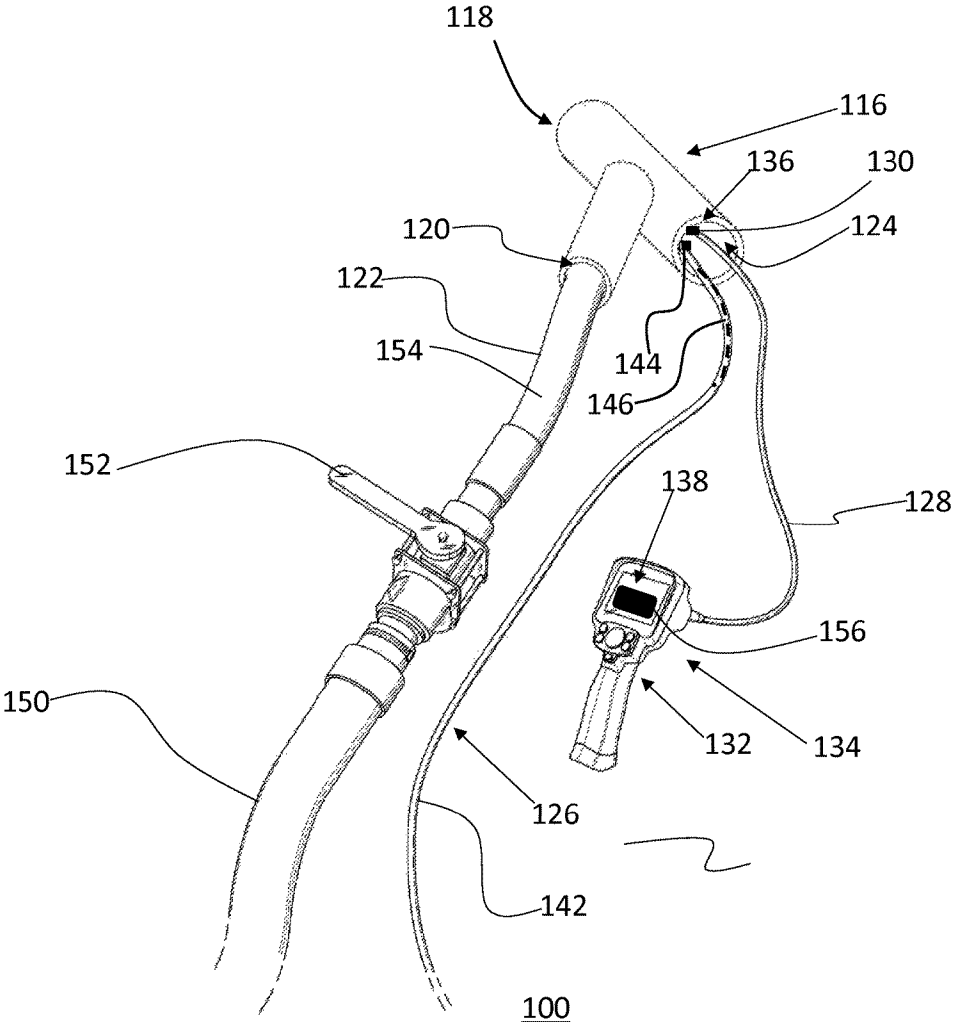
FIG. 1 is a fragmentary view of a method of removing debris from piping in high-rise buildings in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 3:
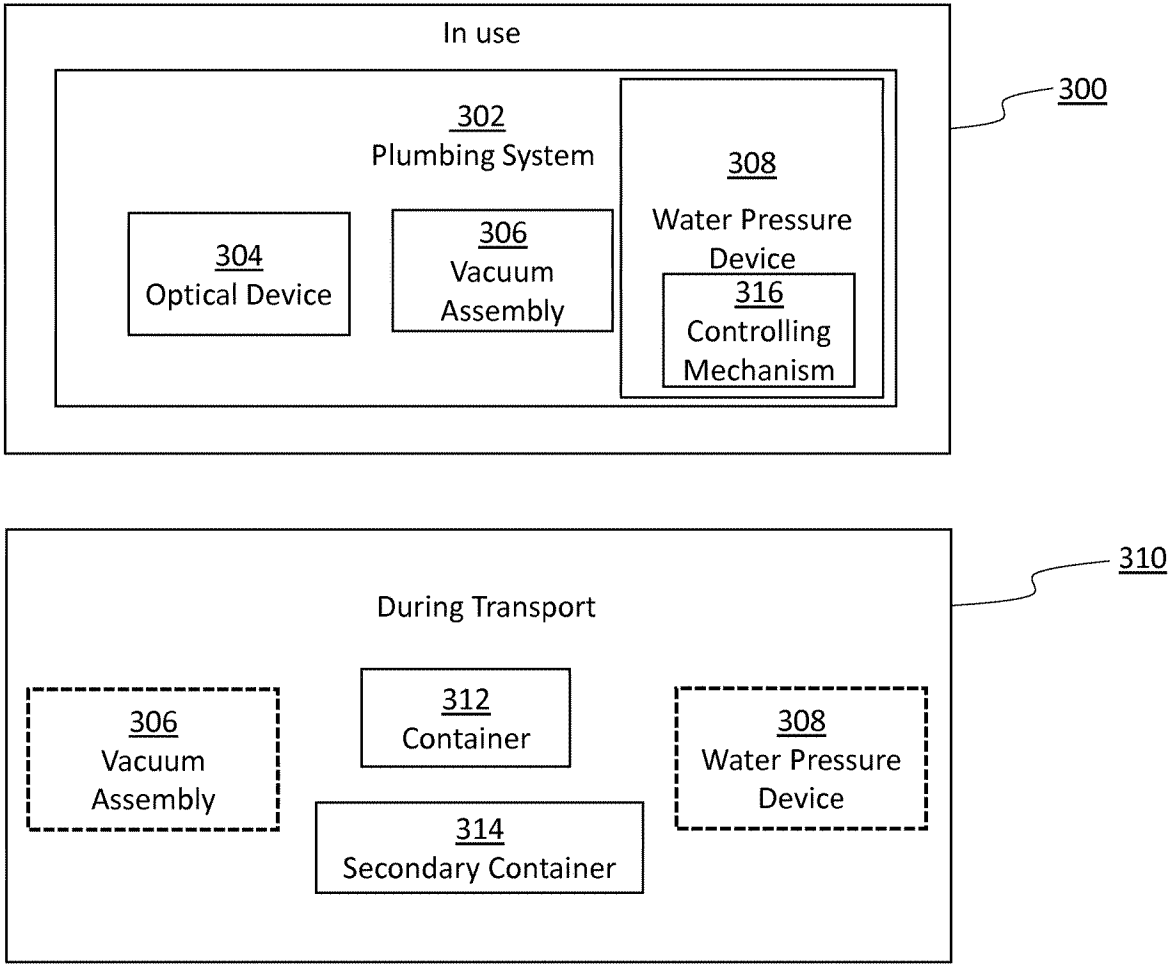
FIG. 3 is a block diagram of an exemplary implementation of a system of removing debris from piping within a high-rise building plumbing network in accordance with the present invention.

The present invention provides a novel and efficient method and system of removing debris from piping within a high-rise building. FIG. 1 depicts a perspective fragmentary view of components utilized in an assembly 100 to carry out the below-described method. FIG. 3 depicts a block diagram showing the aforementioned components, specifically, an optical device 304, a vacuum assembly 306, and a water pressure device 308. With reference to both FIGS. 1 and 3, in one embodiment of the present invention the method and system may include first inserting a portion of an optical device 304 within an opening defined by detaching two piping members within a plumbing system 302 so as not to puncture or damage the piping when attempting to locate the debris. The portion of the optical device 304 inserted within the piping is designed to maneuver within the piping until an image of the debris is identified on the optical device's display screen 138. Once the debris is identified, in contrast to those known methods that fail to completely remove the debris, the present invention provides a method and system that completely removes the debris from the piping using a water pressure device 308 that directs water at the debris for a period of time sufficient to dislodge the debris, and a vacuum caused by the vacuum assembly 306 sufficient to remove the debris from the piping.

FIGS. 1 and 3 show several advantageous features of the present invention, but, as will be described below, the invention can be provided in several shapes, sizes, combinations of features and components, and varying numbers and functions of the components. FIG. 3 provides both an overview of the system of removing debris from piping within a high-rise building 300 in use and during transport 310. When in use, the system of removing debris from piping within a high-rise building 300 includes a plumbing system or network 302, an optical device 304, a vacuum assembly 306 and a water pressure device 308. Advantageously, the system of removing debris from piping within a high-rise building 300 can be transported to various high-rise buildings. When in transport 310 the system of removing debris from piping within a high-rise building 300 may include the vacuum assembly 306, a container 312, a secondary container 314 and the water pressure device 308.

Figure 5:
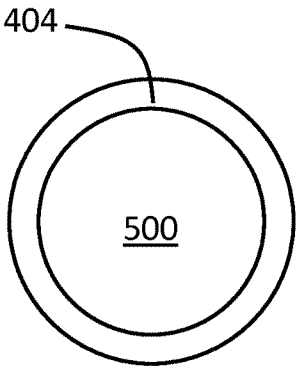
FIG. 5 is an enlarged cross-sectional view A-A of the plumbing network in FIG. 5.
Figure 4:
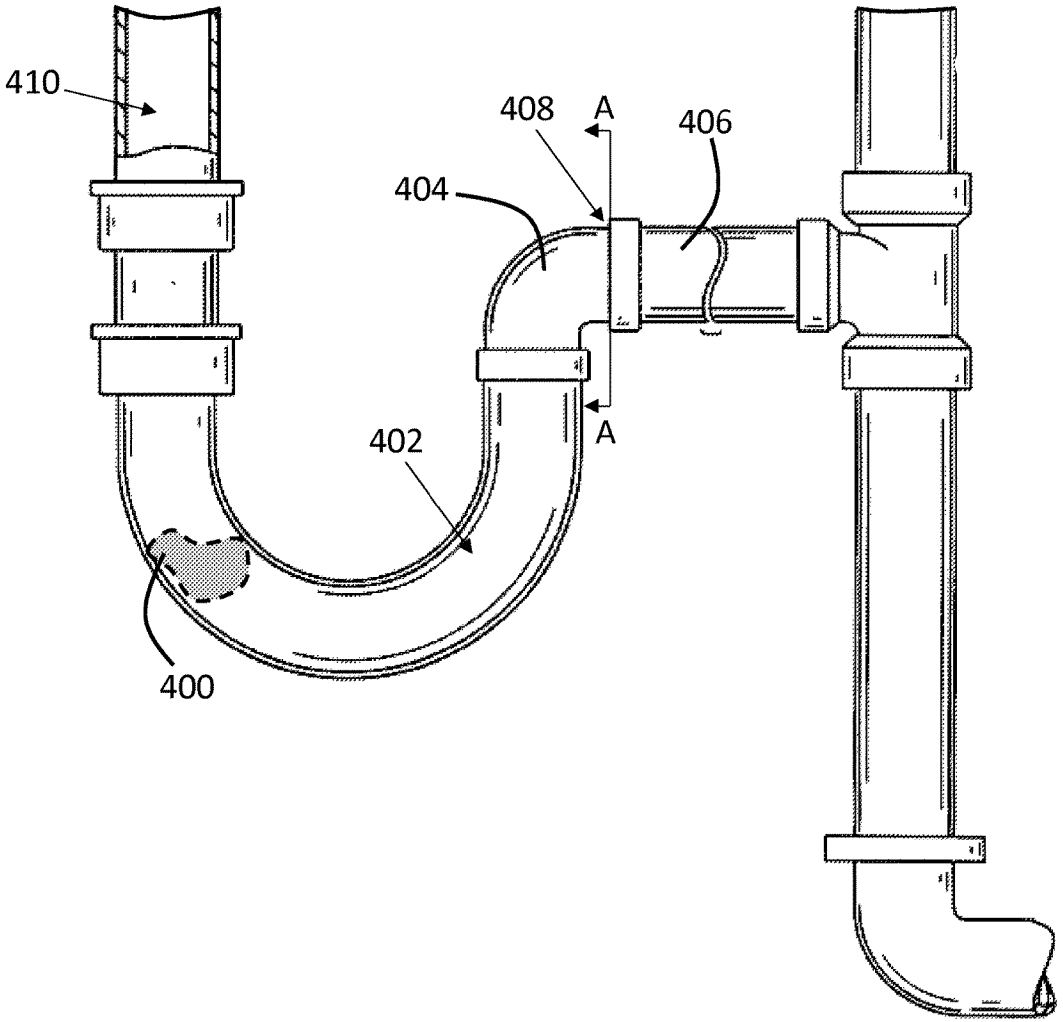
FIG. 4 is a fragmentary view of an exemplary plumbing network that includes plumbing members wherein the method in accordance with one embodiment of the present invention is carried out.

Referring briefly to FIG. 4, described in conjunction with the process flow diagram shown in FIG. 2, the process of removing debris 400 from piping 402 within a high-rise building begins at step 200 and immediately proceeds to step 202 of uncoupling a plurality of plumbing members, e.g., members 404, 406 at a joint 408 in the plumbing system 302 to create an opening 500 (shown in FIG. 5). The plurality of plumbing members 404, 406 may be at least one of a drain extension, a clean out plug, a trap, a tailpiece, or any other structure typically used in a plumbing network or system. In one embodiment, the joint 408 may be a drain flange. The plurality of plumbing members 404, 406 and the joint 408 may vary according to the location their respective locations within the plumbing system 302, i.e., in close proximity to a drain or at a mid-point within the piping.

In an embodiment, the opening 500 is defined by the plumbing system 302. More specifically, the opening 500 may be defined by a terminal end of one of the plurality of plumbing members 404, 406 constituting a part of a piping network within the plumbing system 302. It will be obvious to those of skill in the art that the opening 500 in which the components are coupled to or inserted within is that which is estimated as being the closest to the obstruction of debris 400. This may be based on downstream fluid flow or by trial-and-error. The plumbing members 404, 406 distribute fluid, such as water for drinking, throughout the piping within high-rise building, or remove waste from the piping through at least one drain. The system for removing debris from piping within a high-rise building 300 is designed for use with various types of plumbing systems 302, such as a cast iron sovent system, having a single stack drainage system, or a conventional sewage system having two stacks, e.g., sewage and ventilation, as would be appreciate by one of ordinary skill in the art.

In an embodiment, the opening 500 is disposed downstream of the terminal end of the plumbing system 302 when coupled in normal operation, i.e., not at a drain, and is created by removing two pipes that are removemably couplable together. Advantageously, this configuration permits the creation of the opening 500 without puncturing any piping that may damage the piping or detaching numerous portions of the piping to search for at least a piece of debris 400 within the piping. For example, to create the opening 500, a user can remove a trap without having to remove numerous portions of additional piping. The debris 400 is defined herein as any natural or artificial material or any combination of natural and artificial material including, but not limited to dirt, sludge, garbage, food, hair and any other material capable of obstructing piping. The term "user" is defined herein as a human operator or a programmable machine that may perform the present method through the use of computer software.

Figure 2A:
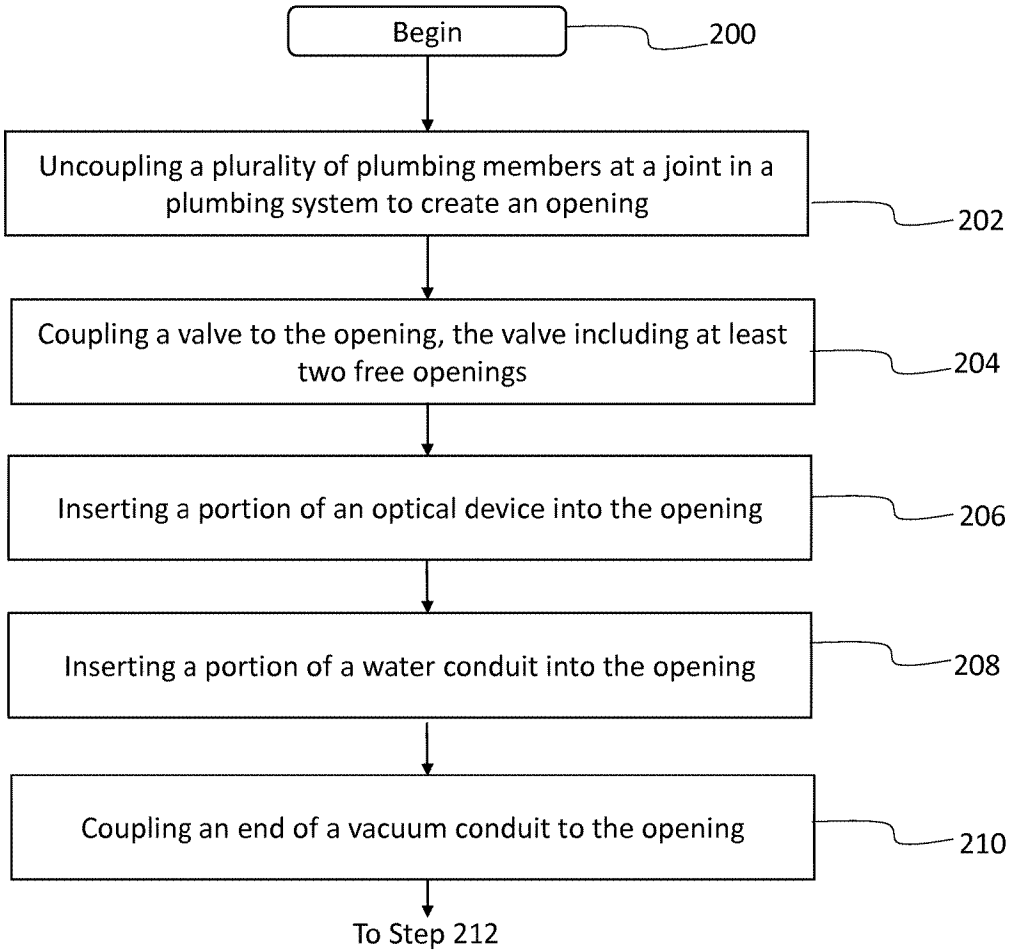
FIG. 2A is a process flow diagram for illustrating the method of removing debris in accordance with FIG. 1.

Referring now to FIG. 1 in conjunction with FIG. 2A, the process continues to step 204 of coupling a fitting 116 to the opening 500 (shown in FIG. 5) in a water-tight configuration to prevent any leaking. In an embodiment, the fitting 116 is y-shaped. More specifically, the fitting 116 is displayed in FIG. 1 as having a three-port arrangement including at least two free openings, 120, 124. FIG. 1 shows a first free opening 118, a second free opening 120, and a third free opening 124. In another embodiment of the present invention, the fitting 116 may incorporate one or more valves therein. The first free opening 118 is operable to removably couple to the opening 500 in the water-tight configuration. The second free opening 120 is operable to receive an end of a vacuum conduit 122 in a fluidly sealed configuration, to prevent any air from leaking when the vacuum is in suction mode while removing the debris 400. The third free opening 124 is operable to receive a portion of the optical device 304 inserted therein and a portion of a water conduit 126. In an embodiment, the fitting 116 is made of PVC material. In another embodiment, the fitting 116 may be made with copper, steel, iron, or another durable material used in a plumbing network.

The process continues to step 206 of inserting the portion of the optical device 304 into third free opening 124. In one embodiment, the optical device 304 includes an arm 128, a lens 130, and a camera 132. The camera 132 is displayed in FIG. 1 as a hand-held camera which can easily be transported to various job sites. In another embodiment, the camera 132 may be a video camera. The arm 128 and lens 130 constitute the portion of the optical device 304 inserted into the third free opening 124. More specifically, the optical device 304 has a proximal end 134 and a distal end 136. The proximal end 134 includes a display screen 138 and the distal end 136 may include the lens 130. The proximal end 134 is coupled to the distal end 136 by the arm 128. In an embodiment, the arm 128 is flexible, such that the arm can bend when inserted into the third free opening 124. The optical device 304, more specifically the arm 128, may also be elongated. The term "elongated" is defined herein as of a length that is longer than the average overall width of a referencing object. In an embodiment, the arm 128 may be at least 3.0 feet in length. In other embodiments, the arm 128 may include an extender to increase the length of the arm 128 outside of this range. The length of the arm 128 may vary depending on the distance between the opening 500 and the location of the debris 400 within a plumbing channel 410 (shown in FIG. 4) defined by the plumbing system 302. The plumbing channel 410 is defined by the inner surface of the piping.

The process continues to step 208, inserting the portion of the water conduit 126 operably coupled to the water pressure device 308, into the third free opening 124. In an embodiment, the water conduit 126 includes a hose 142 and a nozzle 144. The hose 142 and nozzle 144 constitute the portion of the water conduit 126 inserted into the third free opening 124. In an embodiment, the hose 142 may be flexible such that the hose 142 can bend when inserted into the third free opening 124. The water conduit 126, more specifically, the hose 142 can also be elongated. In an embodiment, the hose 142 is at least one hundred feet in length and approximately 0.25 inches in width. In another embodiment, the hose 142 may be less than one hundred feet in length and less or more than 0.25 inches in width. The hose 142 can detach from the water pressure device 308 for compact storage and portability. The water pressure device 308 can be transported on a truck or wheeled to various job sites.

In an embodiment, the water conduit 126 is operable to deliver a stream of fluid 146 generated by the water pressure device 308 into the plumbing channel 410. The term "stream" is defined herein as any flow of liquid and is not limited to water. In an embodiment, the stream of fluid 146 is of a non-gaseous substance. In another embodiment, the stream of fluid is water. The non-gaseous substance permits the user to effectively and efficiently dislodge the debris 400. In another embodiment, the water conduit 126 is operable to deliver air, though the delivery of fluid is preferred because the amount and duration of fluid coming from the water pressure device 308 is easier to control than air. In an embodiment, step 208 may include inducing a selectively pulsating stream of fluid 146 through the water conduit 126. The term "pulsating" is defined herein as varying in speed according to the amount of water pressure supplied by the water pressure device 308. The speed and duration of the stream of fluid are controlled by a controlling mechanism 316 (FIG. 3). The controlling mechanism 316 may be an interchangeable switch, button, or knob removably coupled to a distal end of the water conduit and operable to provide predetermined pressure and flow settings.

The water pressure device 308 generates the stream of fluid 146. The water pressure device 308 generates the stream of fluid 146 that is not limited to water, rather the stream of fluid 146 is any type of fluid. In an embodiment, the water pressure device 308 is a JM-1450 Electric Jet, operable to generate at least 1500 pounds per square inch ("PSI") at 1.7 gallons per minute ("GPM"). In another embodiment, the water pressure device 308 is a heavy duty electric pressure washer capable of generating up to 3,000 PSI and 2.5 GPM. In yet another embodiment, the pressure washer is a gas pressure washer capable of generating up to 3,000 PSI and 2.5 GPM. In other embodiments, the water pressure device may be another type of pressure washer, generating a level of PSI and delivering a flow rate outside of the aforementioned ranges. FIG. 1 displays the water pressure device 308 as portable. Advantageously, the portability allows the water pressure device 308 to easily be maneuvered throughout the high-rise building.

The process continues to step 210 of coupling the end of the vacuum conduit 122 to the second free opening 120 in the fluidly sealed configuration. In an embodiment, as displayed in FIG. 1, the vacuum conduit 122 includes a tube 150 and a control valve 152. The tube 150 is inserted into the second free opening 120. The tube 150 removably couples the vacuum conduit 122 to the vacuum assembly 306 at a second end (not shown). The vacuum conduit 122 may also include a transparent surface 154 located proximal to the end of the vacuum conduit 122. In other embodiments, the transparent surface 154 may be located on the fitting 116 or another portion of the vacuum system 306. Advantageously, through the transparent surface 154, the user is able to view the debris 400 as it is removed from the plumbing channel 410. The vacuum assembly 306 is a pumping and vacuum system that operates to remove and transport the debris 400. The control valve 152 turns the vacuum assembly 306 from an "off" mode to an "on" mode for suction. In an embodiment, the vacuum assembly 306 is a CONDE™ ProVac Industrial Pumpout Station. The CONDE™ ProVac Industrial Pumpout Station may be made with steel or aluminum. In one embodiment, the dimensions of the CONDE™ ProVac Industrial Pumpout Station are 24.0 inches in width, 50.0 inches in length, and 45 inches in height. In one embodiment, the CONDE™ ProVac Industrial Pumpout Station has an intake flow rate of 120 GPM with a tank volume of 52.0 gallons. In another embodiment, the vacuum assembly 306 is a standard vacuum. In yet another embodiment, the vacuum assembly 306 is an industrial vacuum. Advantageously, the vacuum assembly 306 can be transported to various job sites.

Figure 2B:
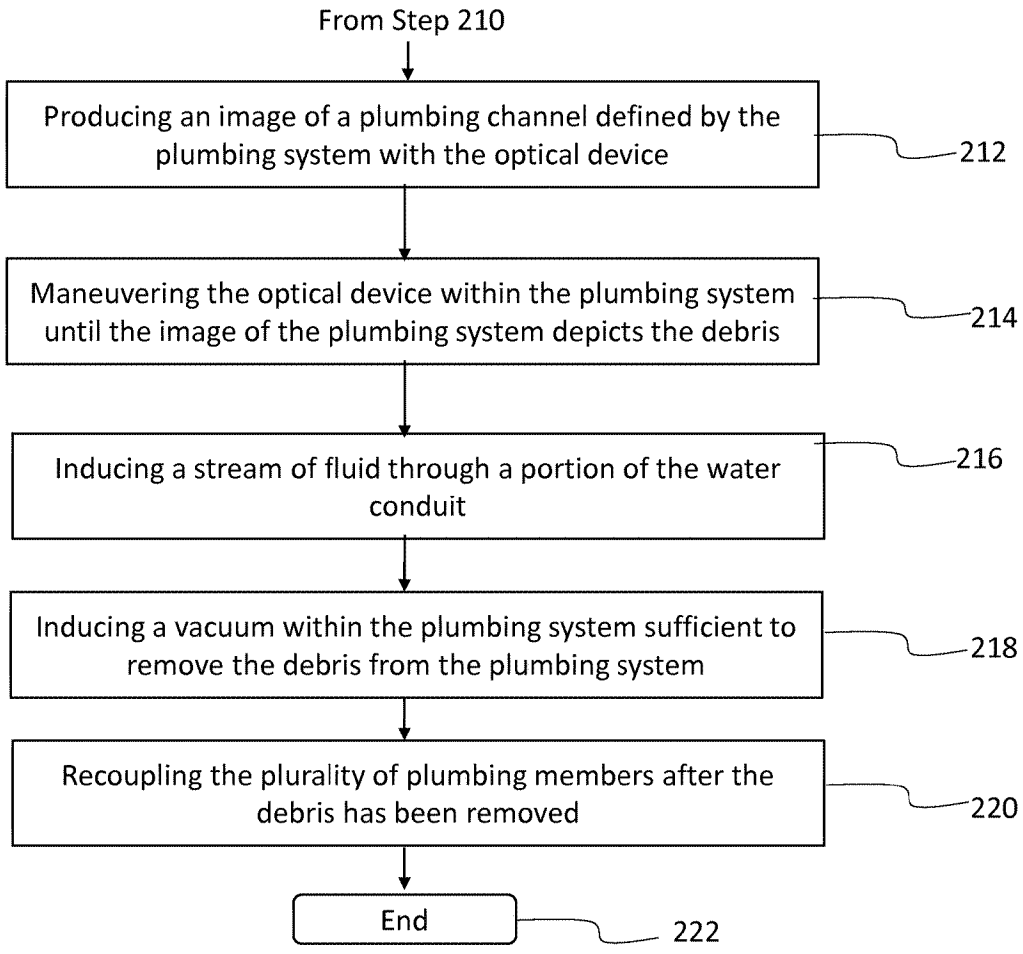
FIG. 2B is a continuation of the process flow diagram of FIG. 2A illustrating the method of removing debris in accordance with FIG. 1.

Referring now to FIG. 1 in conjunction with FIG. 2B, the process continues to step 212 of producing an image 156 or plurality of images of the plumbing channel 410 in real-time. The optical device 304 displays the image 156 on the camera 132. More specifically, the lens 130 surveys the plumbing channel 410 so that the image 156 can be viewed on the display screen 138. The optical device 304 may also produce a still image of the plumbing channel 410, which can be stored on internal memory or a removable storage medium. Obviously, real-time viewing is preferred so that the user can quickly and efficiently identify the debris 400 within the plumbing channel 410 through the lens 130 and display screen 138. As previously stated herein, the user may be a human operator or programmable machine.

The process continues to step 214 of maneuvering the optical device 304 within plumbing channel 410 until the image 156 depicts the debris 400 at least partially obstructing the plumbing channel 410. The term "partially obstructing" is defined herein as obstructing at least 25% of a cross-sectional area of the plumbing channel 410 defined by the plumbing members 404, 406, i.e. the piping. In order for the user to quickly produce the stream of fluid into the plumbing channel 410, both the optical device 304 and the water conduit 126 are maneuvered through plumbing channel 410 simultaneously until the image 156 depicts the partially obstructing debris 400.

Once the partial obstruction is identified, the process continues to step 216 of inducing the stream of fluid through the water conduit 126. The stream of fluid is directed at the debris 400 for a period of time until the debris 400 has been dislodged. The term "dislodged" is defined herein as forced out of position. The speed of the stream of fluid, i.e., flow rate or GPM, sufficient to dislodge the debris 400 will naturally vary, depending on factors such as the weight, size and type of debris. It may also vary based on the bond that the debris 400 has with the inner surface of the channel 410. In one example, the speed sufficient to dislodge the debris 400 may be up to 1.7 GPM. In another example, the speed may be between 1.7 to 2.5 GPM. In another example, the GPM may be greater than 2.5 GPM to dislodge heavy or large pieces of debris 400 that may be at least partially obstructing the plumbing channel 410.

The process continues to step 218 of inducing a vacuum within the plumbing system 302 sufficient to remove the debris 400 from with the plumbing channel 410. Step 216 may performed any time after step 210 and before step 220. The vacuum is created when the pressure level within the hose 142 drops below the pressure level outside of the hose 142. The amount of pressure induced by the vacuum is controlled by the vacuum assembly 306. In one embodiment, the vacuum assembly 306 is the CONDE™ ProVac Industrial Pumpout Station having an operating vacuum level of 16" Hg and an operating pressure of 5 PSI. The negative pressure generated by the vacuum is sufficient to remove the debris 400 from the opening 500. Similar to the rate of water flow, the amount of pressure supplied by the vacuum varies, depending on the weight and size of the piece of debris 400. The amount of pressure supplied by the vacuum may also vary depending on the bond between the debris 400 and the plumbing channel 410.

Referring now to FIG. 3, following the removal of the debris 400, the process continues by housing the debris 400 in the container 312 housed by the vacuum assembly 306. The material of the container 312 is preferably a durable material such as aluminum or steel, which provides the user with the container 312 that is operable to store fluid during the process of removing the debris. Next, the process continues by pumping the debris 400 from the container 312 to a secondary container 314, using a pumping device also housed by the vacuum assembly 306. The secondary container 314 is preferably a portable heavy duty plastic container that can hold at least fifty five gallons of fluid at any given time. Advantageously, this process provides the user with the ability to empty the debris and fluid from the secondary container 314 and continue the process of removing the debris if necessary.

Referring now to FIG. 1 in conjunction with FIG. 2B, the process continues with step 220 of recoupling the plurality of plumbing members 404, 406 after the debris 400 has been removed to create a pre-existing fluidly sealed configuration at the joint 408 in the plumbing system 302 as shown in FIG. 4. The process creates little to no damage to the plumbing system 302 because the process is designed to restore the plumbing members 404, 406 to their pre-existing configuration following the removal of the debris 400. The process ends at step 222.

Figure 6:
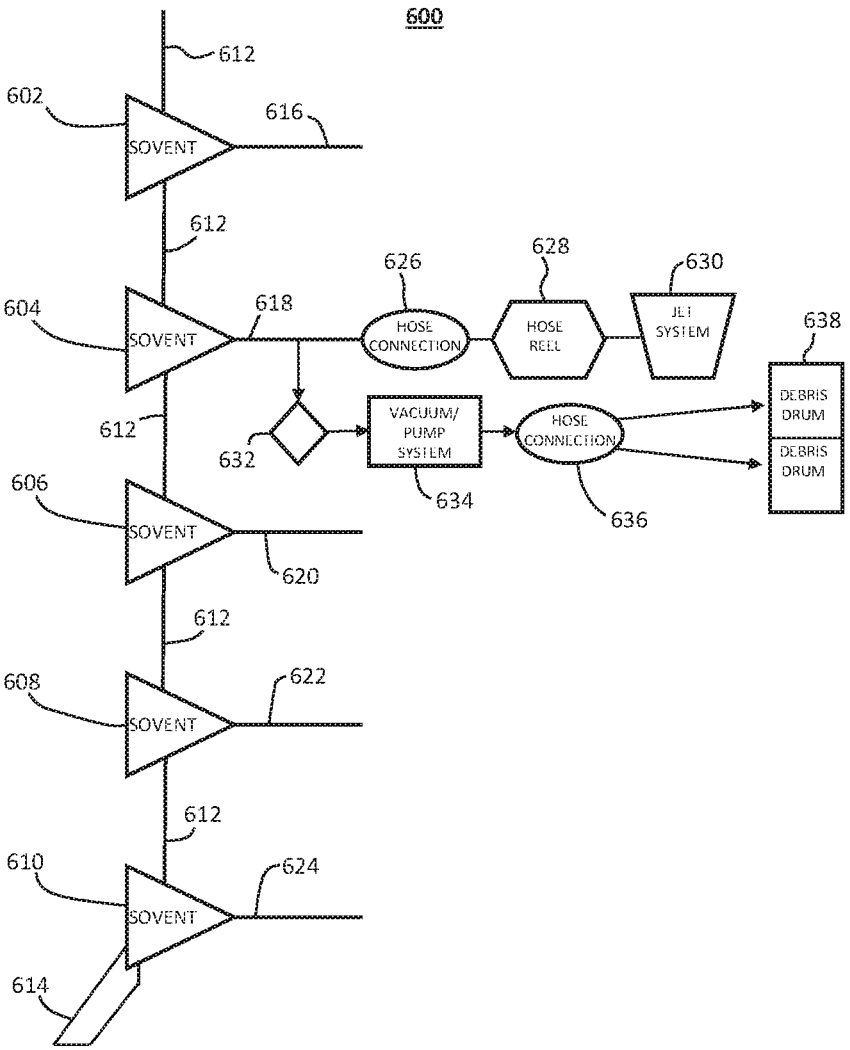
FIG. 6 shows a single stack sovent system in accordance with the present invention.

FIG. 6 shows a single stack sovent system 600 in accordance with the present invention. A sovent system is a single stack drain system that uses one vertical pipe line 612 to both aerate and drain on multiple floors of a building. At each floor a sovent element 602, 604, 606, 608, 610 (each on different floors of a building on line 612) is connected in the vertical pipe line 612. Each sovent element 602, 604, 606, 608, 610 is connected to a respective horizontal line 616, 618, 620, 622, 624 for connecting to fixtures on the respective floor, such as sinks, bath drains, etc. At the bottom of the vertical pipe line 612, below the lowest sovent element 610, is a de-aerator 514 fitting.

It has been found that the vent slot that provides aeration in sovent elements can close due to the build up of debris and scale over time. This slows the airflow in the system and waste and debris does not exit the horizontal lines 616, 618, 620, 622, 624 properly, with free flow. This allows debris to lay in the horizontal lines 616, 618, 620, 622, 624. The horizontal lines 616, 618, 620, 622, 624 are typically eight to fifty feet long. This debris slowly turns to a sludge like substance and eventually fills the line and restricts airflow, causing bubbling in the drains and eventually stops flow completely. Passing a conventional clearing cable through a horizontal line 616, 618, 620, 622, 624 does not break up the sludge. The lack of airflow does not allow sludge to pass through the horizontal line 616, 618, 620, 622, 624. If jetting is used in the restricted (sludge-filled) line it moves the sludge into the main line 612 and worsens the problem by moving the sludge into another area of the building. The invention removes sludge from the and debris from the vertical line 612 and the vent slot in a sovent element 602, 604, 606, 608, 610 to restore and maintain proper air flow through the vertical line 612 and the horizontal lines 616, 618, 620, 622, 624 by combining jetting and vacuuming at the same time so that debris is not sent into the vertical line 612, which could simply result in stoppages at lower floor.

The present invention accomplishes the debris removal by connecting a hose connection 626 to a horizontal line, here horizontal line 518. A hose is supplied by a hose reel 628 to carry water under pressure from a jet system 630. An attachment 632 allows a vacuum/pump system 634 to be used to remove debris dislodged by the jet. The pump system 634 pumps sludge through a hose connection 636 to a debris drum or drums 638 or equivalent receptacle.

What is claimed is:

1. A method of removing debris from piping within a high-rise building, wherein the debris creates at least a partial obstruction in the piping, the method comprising:

uncoupling at least one of a plurality of plumbing members at a joint in a plumbing system to create an opening defined by the plumbing system, wherein the plumbing system is a sovent system including a plurality of sovent elements arranged in a vertical line in a building, with each one of the plurality of sovent elements corresponding to a respective floor of the building, and wherein the joint is in a horizontal line connected to the vertical line;

after uncoupling the at least one of the plurality of plumbing members, coupling a y-shaped fitting to the opening defined by the plumbing system in a watertight configuration, the y-shaped fitting including at least two free openings;

after coupling the y-shaped fitting to the opening defined by the plumbing system:

inserting a portion of a flexible optical device into a first one of the at least two free openings and through the opening defined by the plumbing system;

inserting a portion of a flexible water conduit, operably coupled to a water pressure device, into the first one of the at least two free openings and through the opening defined by the plumbing system;

coupling an end of a vacuum conduit to a second one of the at least two free openings, the vacuum conduit operably coupled to a vacuum assembly and coupled to the second one of the at least two free openings in a fluidly sealed configuration so as to prevent air from leaking from the second one of the at least two free openings when the vacuum assembly is in a suction mode while removing debris;

producing an image of a drain defined by the plumbing system with the flexible optical device;

maneuvering the portion of the flexible optical device within the plumbing system until the image of the drain depicts a debris identified as at least partially clogging the a corresponding sovent element to which the horizontal line connects;

as a result of the image of the drain depicting the debris identified as at least partially clogging the drain, inducing a stream of fluid through the portion of the flexible water conduit, the stream of fluid directed at the debris for a period of time and of a flow rate sufficient to dislodge the debris from the corresponding sovent element; and inducing, by the vacuum assembly, while the stream of fluid is directed at the debris, a vacuum within the plumbing system sufficient to remove the debris from the plumbing system through the end of the vacuum conduit coupled to the second one of the at least two free openings;

uncoupling the y-shaped fitting from the opening defined by the plumbing system after the debris has been removed; and recoupling the at least one of the plurality of plumbing members after uncoupling the y-shaped fitting to create a pre-existing fluidly sealed configuration at the joint in the plumbing system.

2. The method according to claim 1, wherein the portion of the flexible water conduit and the vacuum induced within the plumbing system are both introduced into the plumbing system via the opening defined by the plumbing system.

3. The method according to claim 1, wherein:

the vacuum conduit includes a transparent surface proximal to the end of the vacuum conduit.

4. The method according to claim 1, further comprising:

producing the image of the corresponding sovent element in real-time.

5. The method according to claim 1, further comprising:

displaying the image of the drain on a hand-held camera.

6. The method according to claim 1, wherein:

the stream of fluid reaches a pressure of at least 1500 pounds per square inch.

7. The method according to claim 1, further comprising:

maneuvering the flexible water conduit and the portion of the flexible optical device within the plumbing system simultaneously until the image of the corresponding sovent element depicts the debris identified as at least partially clogging the drain.

8. The method according to claim 1, wherein:

the stream of fluid is of a non-gaseous substance.

9. The method according to claim 1, wherein:

the stream of fluid is water.

10. The method according to claim 1, wherein:

the vacuum is commenced before the stream of fluid is directed at the debris.

11. The method according to claim 1, further comprising:

inducing a selectively pulsating stream of fluid through the portion of the flexible water conduit.

12. The method according to claim 1, further comprising:

storing the debris in a container housed by the vacuum assembly; and pumping the debris, with a pumping device fluidly coupled with the container housed by the vacuum assembly, into a secondary container, the pumping device housed by the vacuum assembly.

13. A method of removing debris from piping within a high-rise building, wherein the debris creates an obstruction in the piping, the method comprising:

uncoupling at least one of a plurality of plumbing members at a joint in a plumbing system to create an opening defined by an end of the at least one of the plurality of plumbing members, wherein the piping is a sovent system including a plurality of sovent elements arranged in a vertical line in a building, with each one of the plurality of sovent elements corresponding to a respective floor of the building, and wherein the joint is in a horizontal line connected to the vertical line, and wherein the opening is in a horizontal line connected to a corresponding sovent element of the plurality of sovent elements and the debris is located in a vent of the corresponding sovent element;

after uncoupling the at least one of the plurality of plumbing members, coupling a three-port fitting to the opening defined by the end of that at least one of the plurality of plumbing members in a water-tight configuration, the three-port fitting including at least two free openings;

after coupling the three-port fitting to the opening defined by the end of the at least one of the plurality of plumbing members:

inserting a portion of an elongated optical device into a first one of the at least two free openings and through the opening defined by the end of the at least one of the plurality of plumbing members constituting a part of a piping network within a plumbing system;

inserting a portion of an elongated water conduit, operably coupled to a water pressure device, into the first one of the at least two free openings and through the opening defined by the end of the at least one of the plurality of plumbing members;

coupling an end of a vacuum conduit to a second one of the at least two free openings, the vacuum conduit operably coupled to a vacuum assembly and coupled to the second one of the at least two free openings in a fluidly sealed configuration so as to prevent air from leaking from the second one of the at least two free openings when the vacuum assembly is in a suction mode while removing debris;

maneuvering the portion of the elongated optical device within the plumbing system to identify a debris at least partially clogging a drain within the plumbing system;

as a result of identifying the debris, inducing a stream of non-gaseous fluid through the portion of the elongated water conduit, the stream of non-gaseous fluid directed at a piece of the debris for a period of time and of a flow rate sufficient to dislodge the piece of the debris clogging the drain; and inducing, by the vacuum assembly, while the stream of fluid is directed at the debris, a vacuum within the plumbing system sufficient to remove the piece of the debris from the plumbing system through the end of the vacuum conduit coupled to the second one of the at least two free openings;

uncoupling the three-port fitting from the opening defined by the end of the at least one of the plurality of plumbing members after the debris has been removed; and recoupling the at least one of a plurality of plumbing members after uncoupling the three-port fitting to create a pre-existing fluidly sealed configuration at the joint in the plumbing system.

14. The method according to claim 13, wherein the portion of the elongated water conduit and the vacuum induced within the plumbing system are both introduced into the plumbing system via the opening defined by the end of one of the plurality of plumbing members.

15. The method according to claim 13, further comprising:

identifying the debris using real-time images of the drain on a hand-held camera.

16. The method according to claim 13, further comprising:

controlling a speed and duration of the stream of non-gaseous fluid through a controlling mechanism.

17. The method according to claim 13, further comprising:

housing the debris in a container removably coupled by the vacuum assembly; and pumping the debris, with a pumping device fluidly coupled to the container into a secondary container, the secondary container operable to hold at least fifty five gallons of fluid.

18. The method according to claim 13, wherein the stream of fluid is at a pressure of at least 1500 pounds per square inch.

* * * * *